United States Patent [19]

Berkes et al.

[11] Patent Number: 4,672,018

[45] Date of Patent: Jun. 9, 1987

[54] FLASH FUSING PROCESS WITH PRESPHEROIDIZED TONER

[75] Inventors: John S. Berkes, Webster, N.Y.; Raymond A. Yourd, III, Cleveland Heights, Ohio; Ronald J. Koch, Webster, N.Y.

[73] Assignee: Xerox Corporation, Stamford, Conn.

[21] Appl. No.: 809,359

[22] Filed: Dec. 16, 1985

[51] Int. Cl.[4] ..... G03G 13/20

[52] U.S. Cl. ..... 430/124; 430/111; 430/126

[58] Field of Search ..... 430/111, 124

[56] References Cited

U.S. PATENT DOCUMENTS

| | | | |
|---|---|---|---|
| 2,965,573 | 12/1960 | Gundlach | 252/62.1 |
| 3,876,610 | 4/1975 | Timmerman et al. | 260/42.21 |
| 3,893,935 | 7/1975 | Jadwin et al. | 252/62.1 |
| 4,229,512 | 10/1980 | Lenhard et al. | 430/106 |
| 4,271,248 | 6/1981 | Gaudioso | 430/124 X |
| 4,415,645 | 11/1983 | Kouchi et al. | 430/107 |

*Primary Examiner*—Roland E. Martin

*Attorney, Agent, or Firm*—E. O. Palazzo

[57] ABSTRACT

Disclosed is a process for affecting a reduction in fusing energy and permitting minimal image de-enhancement which comprises (1) providing a toner composition with toner resin particles, and pigment particles; (2) affecting spheroidization of the aforementioned toner composition; (3) incorporating the spheroidized toner composition into a xerographic imaging apparatus with a flash fusing device incorporated therein; (4) generating an electrostatic latent image in the imaging apparatus; (5) developing the image formed with the spherical toner composition; (6) transferring the image to a supporting substrate; and (7) permanently affixing the image thereto with energy emitted from a flash fusing device.

17 Claims, 4 Drawing Figures

FLASH FUSING PROCESS WITH PRESPHEROIDIZED TONER

BACKGROUND OF THE INVENTION

This invention is generally directed to flash fusing processes, and more specifically the present invention relates to processes for affecting a reduction in the energy required for flash fusing while simultaneously, for example, minimizing image de-enhancement. Therefore, in one embodiment of the present invention there is provided a process for accomplishing a reduction in flash fusing energy for electrostatographic imaging systems wherein the toner particles selected are prespheroidized. With prespheroidization of the toner particles by heat spheroidization processes, for example, there results a desirable decrease in the energy required for affecting flash fusing of the developed images. The process of the present invention, therefore, is particularly useful for permitting image de-enhancement minimization and flash fusing energy reduction in electrostatographic imaging systems having incorporated therein a flash fusing device.

The formation and development of images on the surface of electrophotographic material, such as photoreceptors, for example, by electrostatic means is well known, these processes involving subjecting the photoconductive material to a uniform charge, and subsequently exposing the surface thereof to a light image of the original to be reproduced. The latent image thus formed on the xerographic photoconductive surface is developed with toner particles specifically prepared for this purpose. Thereafter the developed image can be transferred to a final support material such as paper, and affixed thereto enabling a permanent record or copy of the original. Numerous methods are known for applying the electrostatic toner particles to the electrostatic latent image, including for example, cascade development, magnetic brush development, powder cloud development, and touchdown development.

The image formed can be fixed by a number of various well known techniques including, for example, vapor fixing, radiant fixing, pressure fixing, or combinations thereof, as described, for example, in U.S. Pat. No. 3,539,161. These techniques of fixing while suitable for certain purposes suffer from some deficiencies thereby rendering their use either impractical or difficult for specific electrostatographic applications. For example, it is difficult to construct an entirely satisfactory radiant fuser which has high efficiency, can be easily controlled, and has a desirable short warm-up time. Also, radiant fusers sometimes burn or scorch the support material. Somewhat similar problems including, for example, image offsetting and undesirable resolution degradation are present with pressure fusing methods. Additionally, with these processes, consistently desirable permanent images are not obtained. Further, although vapor fixing has advantages, one of its main disadvantages is that a toxic solvent is used, therefore, in many situations this method becomes commercially unattractive in view of health hazards associated therewith. Also, in vapor fixing equipment and apparatus to sufficiently isolate the fuser from the surrounding area is very complex, costly, and difficult to operate.

Many of the modern electrostatographic reproducing apparatuses, which are capable of producing copies at an extremely rapid rate, created the need for the development of new materials and processing techniques.

With these systems, radiant flash fusing is one of the preferred fixing processes selected in that the energy which is emitted in the form of electromagnetic waves is immediately available, and requires no intervening medium for its propogation. Although an extremely rapid transfer of energy between the source and the receiving body is provided with the flash fusing process, a problem encountered with this process resides in obtaining an apparatus which can fully and efficiently utilize a preponderance of the radiant energy emitted by the source during a relatively short flash. The toner image in these systems usually comprises a relatively small percentage of the total area of the copy receiving the radiant energy causing some of the energy generated to be wasted as it is transmitted to the image, or is reflected away from the fusing areas. Furthermore, many of the toner compositions currently available, particularly colored toner compositions, contain pigments which do not absorb energy in the near infrared region of the spectrum thereby necessitating the supply of larger amounts of energy to these compositions in order to affect fusing. Moreover, many of the known colored toner compositions contain pigments therein which do not absorb energy in the near infrared and/or ultraviolet region of the spectrum, thus only about 33 percent of the spectral energy generated, for example, from presently used Xenon lamps is absorbed by the colorants contained in the toner composition.

Generally, radiation energy emitted from a Xenon flash lamp, or similar source, is absorbed by the pigment or dye contained in the toner composition; and thereafter, this energy is converted to thermal energy by a radiationless decay process enabling heat generation causing the toner particles to fuse. The flash energy used is absorbed in a layer of toner of finite thickness adjoining the outer toner surface, with absorption being greatest at the surface. This energy also constantly decreases with increasing distance from the outer toner surface. Also, the flash generated is of very short duration, on the order of about one millisecond, and consequently the toner regions very close to the surface are heated to a much higher temperature than the toner mass as a whole.

Examples of known flash fusing systems that may be selected for the present invention include those as described in U.S. Pat. Nos. 3,529,125; 3,903,394; and 3,474,223, the disclosure of each of these patents being totally incorporated herein by reference. Generally, the flash fuser selected contains a Xenon lamp, the output of the lamp being primarily in the visible and near infrared wavelengths of the regions. The output of the flash lamp is measured by joules using the capacitor bank energy in accordance with the formula $\frac{1}{2}CV^2$ wherein C is capacitance and V is the voltage. One of the main advantages of such a flash fuser over other known methods of fusing is, as indicated herein, that the energy propagated in the form of electromagnetic waves is immediately available, and no intervening source is needed. Also, such flash fusing systems do not require long warm-up periods, and the energy does not have to be transferred through a relatively low conductive or corrective heat transfer mechanism.

Moreover, a percentage of the flash fusing energy apparently is consumed by the toner particles to affect spheroidization thereof, a rather surprising finding as illustrated hereinafter. Thus, for example, it is believed that about 2 joules of energy are initially consumed by the toner particles to affect spheroidization thereof. In accordance with the process of the present invention, this problem is eliminated. Additionally, the process of the present invention enables image deenhancement minimization. By de-enhancement is meant the reduction of image density caused by, for example, the spheroidization and coalescence of the toner particles during the flash fusing process. This de-enhancement can be decreased somewhat and the image density improved when the toner is caused to wet the supporting substrate and spread out; that is, it becomes liquified and covers the substrate with toner particles which are prespheroidized prior to the flash fusing operation; that is, the process of the present invention, image de-enhancement, is substantially eliminated particularly for image densities equal to or less than 1.

Accordingly, there is a need for processes that will permit the efficient flash fusing of images generated in electrostatographic apparatuses. There is also a need for processes that will enable the reduction in flash fusing energy requirements. Further, there is a need for processes permitting a reduction in image de-enhancement or optical density. Furthermore, there is a need for accomplishing the prespheroidization of toner particles thereby allowing their use in electrostatic systems having incorporated therein flash fusing devices, and wherein the energy requirements thereof are significantly reduced. There is also a need for decreasing the cost and size of toner powder supplies for flash fusing; and further the reduction of image de-enhancement enables flash fusing energy reductions.

For a better understanding of the invention as well as other aspects and further features thereof, reference is had to the following drawings and descriptions.

SUMMARY OF THE INVENTION

Figure 1:
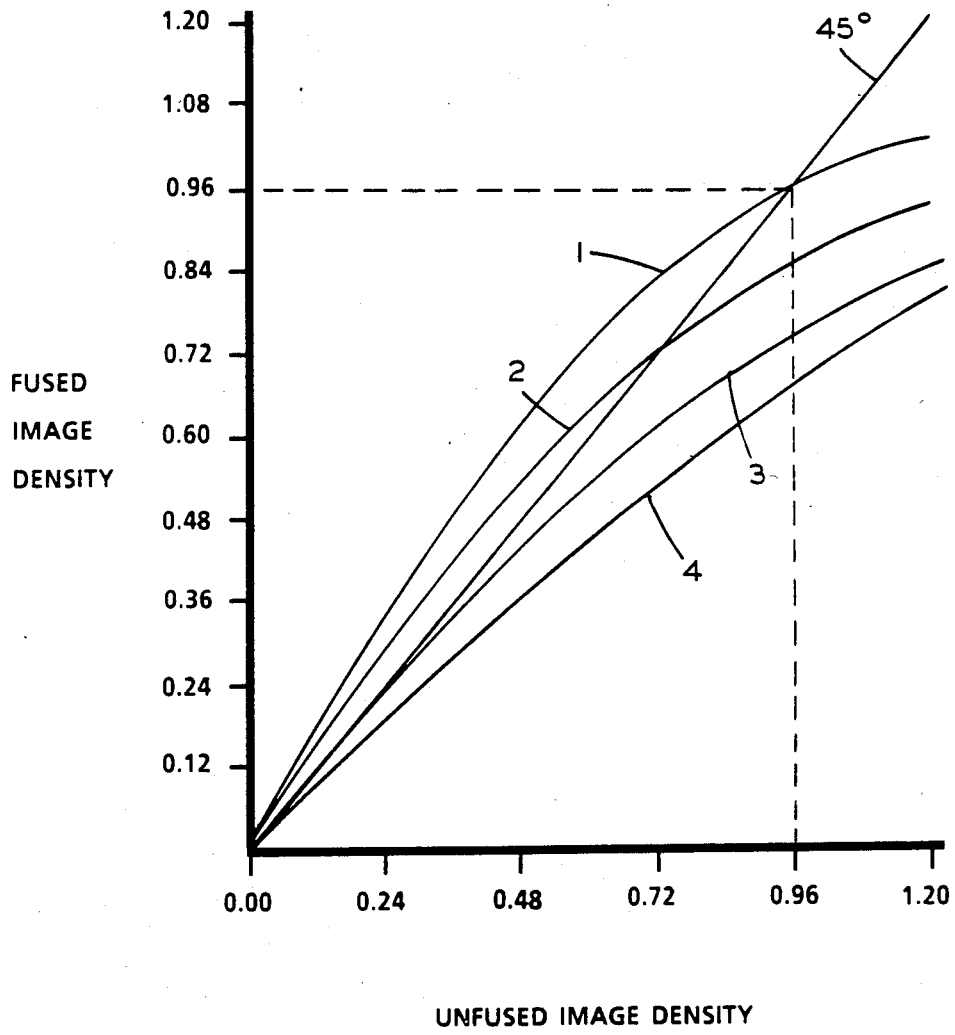
FIG. 1 represents line graph curves wherein the unfused image density is plotted against the fused image density, wherein the toner composition has not been heat spheroidized.

It is an object of the present invention to provide flash fusing processes.

Another object of the present invention resides in the provision of electrostatographic imaging systems with flash fusing energy sources therein and wherein there results a reduction in fusing energy requirements.

Also, in a further object of the present invention there are provided processes that permit minimum image de-enhancement.

In still yet another of the present invention there are provided prespheroidized toner particles enabling a decrease in the flash fusing energy requirements for permitting permanent attachment of a developed image to a suitable substrate.

These and other objects of the present invention are accomplished by the provision of processes for enabling flash fusing energy reductions, and image de-enhancement minimization. More specifically, in one embodiment the process of the present invention comprises accomplishing spheroidization of the toner particles prior to their selection for the development of electrostatographic images in an imaging apparatus having incorporated therein a flash fusing device. In one embodiment, thus the process of the present invention comprises (1) providing a toner composition comprised of resin particles, pigment particles, and optional additive particles; (2) spheroidizing the aforementioned toner composition; (3) introducing the resulting toner composition into a xerographic imaging apparatus; (4) causing the development of electrostatic latent images with the prespheroidized toner particles; (5) transferring the developed image to a suitable substrate; and (6) permanently affixing the image thereto by flash fusing and wherein there is enabled a reduction in the flash fusing energy and image de-enhancement minimization.

Additionally, there is provided in accordance with the present invention, in one very preferred embodiment, a process which comprises (1) providing toner compositions comprised of toner particles that melt readily, that is, at a temperature of from about 100° C. to about 250° C., or possess a glass transition temperature (Tg) of from about 40 to about 60° C. such as polyester resins, pigment particles, and flow aid additives; (2) affecting spheroidization of the aforementioned toner composition by heating to a temperature of from about 400° to about 600° F. in known heat spheroidization apparatuses; (3) classifying the toner particles wherein the average diameter thereof is from about 10 microns to about 20 microns; (4) introducing the spheroidized toner composition into a xerographic imaging apparatus having incorporated therein a flash fusing device; (5) generating an electrostatic latent image in the imaging device; (6) affecting development of the image with the spheroidized toner composition; (7) transferring the developed image to a substrate; and (8) permanently fixing the images thereto by energy emitted from a flash fusing device wherein the energy required is reduced from about 7 joules/inch$^2$ to about 5 joules/inch$^2$, and wherein minimum image de-enhancement occurs.

With further regard to the present invention, it is critical thereto that the toner composition particles be treated in a manner that will enable their transformation from a noncircular dimension to a spherical dimension. Many of the commercially available toner compositions are primarily noncircular in shape, or of irregular shapes, that is, with a diameter of from about 10 microns to about 20 microns, and a circumference of from about 19 microns to about 63 microns. While these toner compositions are sufficient for their intended purposes, when selected for imaging apparatuses with flash fusing devices, it is believed that the initial energy generated by the device is undesirably consumed in converting the circular toner particles into a spherical shape. By spherical, in accordance with the process of the present invention, is meant toner particles with a diameter of from about 6 microns to about 20 microns at the middle portion thereof. Moreover, the use of spherical toner particles permits minimum image de-enhancement. Additionally, with the process of the present invention the effective energy reduction, for example, is about 1.5 joules/inch$^2$ when 7 joules/inch$^2$ of energy is emitted for the flash fusing step; that is, there is about a 20 percent reduction in the flash fusing energy required as compared to flash fusing processes wherein the toner particles are not prespheroidized.

Spheroidization of the toner compositions can be accomplished by a number of known suitable methods including heat spheroidization apparatuses wherein the particles are heated, for example, in a spray dryer, such as a Bowen 30-inch spray dryer, at a temperature of from 300° to about 600° F. After cooling, the spherical toner particles which were initially circular in shape are collected from the heat spheroidization apparatus. Additionally, the particle sizes of the spheroidized toner particles can be determined by a Layson cell measurement, and the spherical shape was confirmed by SEM observations. Further, subsequent to spheroidization, no further classifications of the resulting toner particles which have an average particle diameter of, for example, from about 12 to about 13 microns, needs to be accomplished.

Illustrative examples of toner resins useful for the process of the present invention include, for example, those substances that melt and flow readily, and that possess low viscosity parameters inclusive of polyesters; styrene methacrylates; diolefins such as styrene butadienes; styrene acrylates; ethoxies; polyurethanes, and mixtures thereof. Particularly preferred toner resin particles selected for the process of the present invention are polystyrene methacrylate resins; polyester resins including those illustrated in U.S. Pat. Nos. 3,655,374 and 3,590,000, the disclosures of which are totally incorporated herein by reference; and polyester resins resulting from the condensation of dimethyl terephthalate, 1,3-butanediol and pentaerythritol. Also, waxes such as polypropylene with a molecular weight of less than 6,000 may be incorporated into the toner composition in an amount of from 1 to 25 percent by weight.

Very preferred polyester resins selected for the process of the present invention are comprised of the polymeric esterification product of a dicarboxylic acid and a diol comprising a diphenol of the following formula:

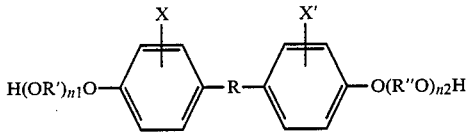

wherein R is selected from substituted and unsubstituted alkylene radicals having from about 2 to about 12 carbon atoms, alkylidene radicals having from 1 to 12 carbon atoms and cycloalkylidene radicals with from 3 to 12 carbon atoms; R' and R'' are selected from substituted and unsubstituted alkylene radicals with from 2 to 12 carbon atoms, alkylene arylene radicals having from 8 to 12 carbon atoms and arylene radicals; X and X' are selected from hydrogen or an alkyl radical of from 1 to 4 carbon atoms; and each n is a number of from 0 (zero) to 4. Diphenols wherein R represents an alkylidene radical of from 2 to 4 carbon atoms, and wherein R' and R'' represent an alkylene radical with from 3 to 4 carbon atoms are preferred as greater blocking resistance, increased definition of xerographic characters, and more complete transfer of the toner images are achieved. Optimum results are obtained with diols in which R is an isopropylidene radical, and R' and R'' are selected from the group consisting of propylene and butylene radicals, and n is 1 (one), as the resins formed from these diols possess higher agglomeration resistance and penetrate extremely rapidly into paper receiving sheets.

Typical diphenols with the foregoing general formula include: 2,2-bis(4-beta hydroxy ethoxy phenyl)-propane; 2,2-bis(4-hydroxy isopropoxy phenyl)propane; 2,2-bis(4-beta hydroxy ethoxy phenyl)petane; 2,2-bis(4-beta hydroxy ethoxy phenyl)-butane; 2,2-bis(4-hydroxy-propoxy-phenyl)-butane; 2,2-bis(4-hydroxy-propoxy-phenyl)propane; 1,1bis(4-hydroxy-ethoxy-phenyl)butane; 1,1-bis(4-hydroxy isopropoxy-phenyl)-heptane; 2,2-bis(3-methyl-4-beta-hydroxy ethoxy-phenyl)propane; 1,1-bis(4-beta hydroxy ethoxy phenyl)-cyclohexane; 2,2'-bis(4-beta hydroxy ethoxy phenyl)-norbornane; 2,2'-bis(4-beta hydroxy ethoxy phenyl)norbornane; 2,2-bis(4-beta hydroxy styryl oxyphenyl)propane; the polyoxy-ethylene ether of isopropylidene diphenol in which both phenolic hydroxyl groups are oxyethylated and the average number of oxyethylene groups per mole is 2.6; the polyoxypropylene ether of 2-butylidene diphenol, in which both the phenolic hydroxyl groups are oxyalkylated and the average number of oxypropylene groups per mole is 2.5; and the like.

Suitable dicarboxylic acids that may be reacted with the diols described to form the toner resins for the process of this invention, which acids may be substituted, unsubstituted, saturated or unsaturated, include those of the general formula:

$$HOOCR'''_{n3}COOH$$

wherein R''' is a substituted or unsubstituted alkylene radical of from 1 to 12 carbon atoms, arylene radicals or alkylene arylene radicals having from 10 to 12 carbon atoms and n is a number of less than 2. By dicarboxylic acid it is intended to include the known anhydrides of such acids. Typical dicarboxylic acids and anhydrides include oxalic acid, malonic acid, succinic acid, glutaric acid, adipic acid, pimelic acid, suberic acid, azelaic acid, sebacic acid, phthalic acid, mexaconic acid, homophthalic acid, isophthalic acid, terephthalic acid, o-phenylene-acetic-beta-propionic acid, itaconic acid, maleic acid, maleic acid anhydrides, fumaric acid, phthalic acid anhydride, traumatic acid, citraconic acid, and the like. Dicarboxylic acids having from 3 to 5 carbon atoms are preferred as the resulting toner resins possess greater resistance to film formation on reusable imaging surfaces. Optimum results are obtained with alpha unsaturated dicarboxylic acids, such as fumaric acid, maleic acid, or maleic acid anhydrides as maximum resistance to physical degradation of the toner as well as rapid melting properties are achieved. Although it is not entirely clear, it is believed that the presence of the unsaturated bonds in the alpha unsaturated dicarboxylic acid reactants provides the resin molecules with a degree of toughness without adversely affecting the fusing and comminution characteristics.

The preferred polyester material of the present invention is comprised of the reaction product of 2,2-bis(4-hydroxy isopropoxy phenyl) propane and fumaric acid, as such a polyester when used as the toner resin results in images of very high resolution and superior quality.

As pigment particles there can be selected, in an amount of from about 5 percent by weight to about 20 percent by weight, carbon black, nigrosine dyes, and other similar substances providing they impart the desired black color to the composition selected. Particularly useful carbon black substances are Black Pearls L, Regal® 330, Vulcan®, and mixtures thereof.

External additives added as optional ingredients to the toner composition of the present invention include colloidal silicas, such as Aerosil, metal salts, metal salts of fatty acids such as zinc stearate, mixtures thereof and the like, reference U.S. Pat. No. 3,983,045, the disclosure of which is totally incorporated herein by reference; and U.S. Pat. No. 3,320,169, the disclosure of which is totally incorporated herein by reference. The Aerosil materials function primarily as a charging source, and are preferably present when negatively charged toner compositions are desired, while the salts which function as lubricating agents are preferably selected with blade cleaning systems. From about 0.2 percent to about 0.8 percent based on the weight of the toner ingredients, and preferably from about 0.5 percent to about 0.8 percent of the colloidal silicas are selected for incorporation into the toner composition. The external salt additives are present in an amount of from about 0.10 percent to about 0.6 percent, and preferably from about 0.3 percent to 0.5 percent. Percentages outside these ranges may be useful providing the objectives of the present invention are achievable.

The toner compositions generated in accordance with the process of the present invention can be admixed with carrier components thereby permitting the formulation of developer compositions.

Typical carrier materials that can be used for forming the developing composition of the present invention include those that are capable of triboelectrically obtaining a charge of opposite polarity to that of the toner particles. Examples of carriers include potassium chloride, Rochelle salt, sodium nitrate, aluminum nitrate, potassium chlorate, granular zircon, granular silicon, methyl methacrylate, glass, steel, nickel, iron ferrites, silicon dioxide and the like. Preferably, the carrier particles selected contain coatings thereover inclusive of polymethyl methacrylates; terpolymers of styrene, methacrylate, and vinyl triethoxy silane, reference U.S. Pat. No. 3,526,533, the disclosure of which is totally incorporated herein by reference; and other similar equivalent coatings. Also, nickel berry carriers as illustrated in U.S. Pat. Nos. 3,847,604 and 3,767,598, the disclosures of which are incorporated herein by reference, may be useful. These carriers are comprised of nodular beads of nickel with surfaces of reoccuring recesses and protrusions providing particles with a relatively large external area. Further, the diameter of the coated carrier particles is from about 50 to about 500 microns thus allowing the carrier to present sufficient density and inertia to avoid adherence to the electrostatic images during the development process. The preferred carrier is comprised of a steel core coated with a polymethyl methacrylate resin, or the terpolymer resins of U.S. Pat. Nos. 3,526,533 and 3,467,634, the disclosures of which are totally incorporated herein by reference.

The carrier may be mixed with the toner composition in various effective suitable combinations, however, best results are obtained when there is used from about 0.5 parts to about 10 parts of toner to about 100 to 200 parts by weight of carrier, and preferably from about 3 parts of toner to 100 parts by weight of carrier.

The compositions of the present invention may be selected for the development of images in an electrostatographic apparatus having preferably incorporated therein various different inorganic photoreceptors including amorphous selenium; selenium alloys, such as selenium antimony, selenium arsenic tellurium, selenium tellurium, selenium antimony tellurium, and selenium arsenic.

Especially useful flash fusing devices are Xenon lamps, which generally generate energy in an amount of from about 1 joules/inch$^2$ to about 15 joules/inch$^2$. Also, the spectral distribution of a Xenon discharge is primarily contained between 0.3 nanometers and 1.0 nanometers.

The invention will now be described in detail with respect to specific preferred embodiments thereof, it being understood that these examples are intended to be illustrative only and the invention is not intended to be limited to the materials, conditions, process parameters, and the like recited herein. All parts and percentages are by weight unless otherwise indicated.

EXAMPLE I

There was prepared by melt mixing followed by mechanical attrition a toner composition containing 90 percent by weight of the polyester resin which is the reaction product of 2,2-bis(4-hydroxy isopropoxy phenol) propane and fumaric acid, commercially available from ICI Corporation; 10 percent by weight of Black Pearls L carbon black; and as an external additive that is not part of the resin blend 0.65 percent by weight of Aerosil R972. The aforementioned mixture was then subjected to heat spheroidization at a temperature of 530° F., reference U.S. Pat. No. 3,639,245, the disclosure of which is totally incorporated herein by reference. Subsequent to separation from the heat spheroidization apparatus there resulted spherical toner particles.

Three parts by weight of the above toner composition with 100 parts by weight of carrier particles comprised of a steel core coated with a methyl terpolymer of styrene, methyl methacrylate, and a triethoxy silane, were admixed and subsequently incorporated into a xerographic imaging fixture with a flash fusing device containing a Xenon lamp. Subsequent to development of the image on the selenium photoreceptor and transfer to paper, the image was fixed with the heat generated from the Xenon lamp, this fixing occuring with 5.5 joules/inch$^2$ of energy. In contrast, an identical toner composition, with the exception that it was not subjected to heat spheroidization when admixed with the same carrier and incorporated into the above imaging fixture, required 7 joules/inch$^2$ to permanently fix the image generated.

Figure 2:
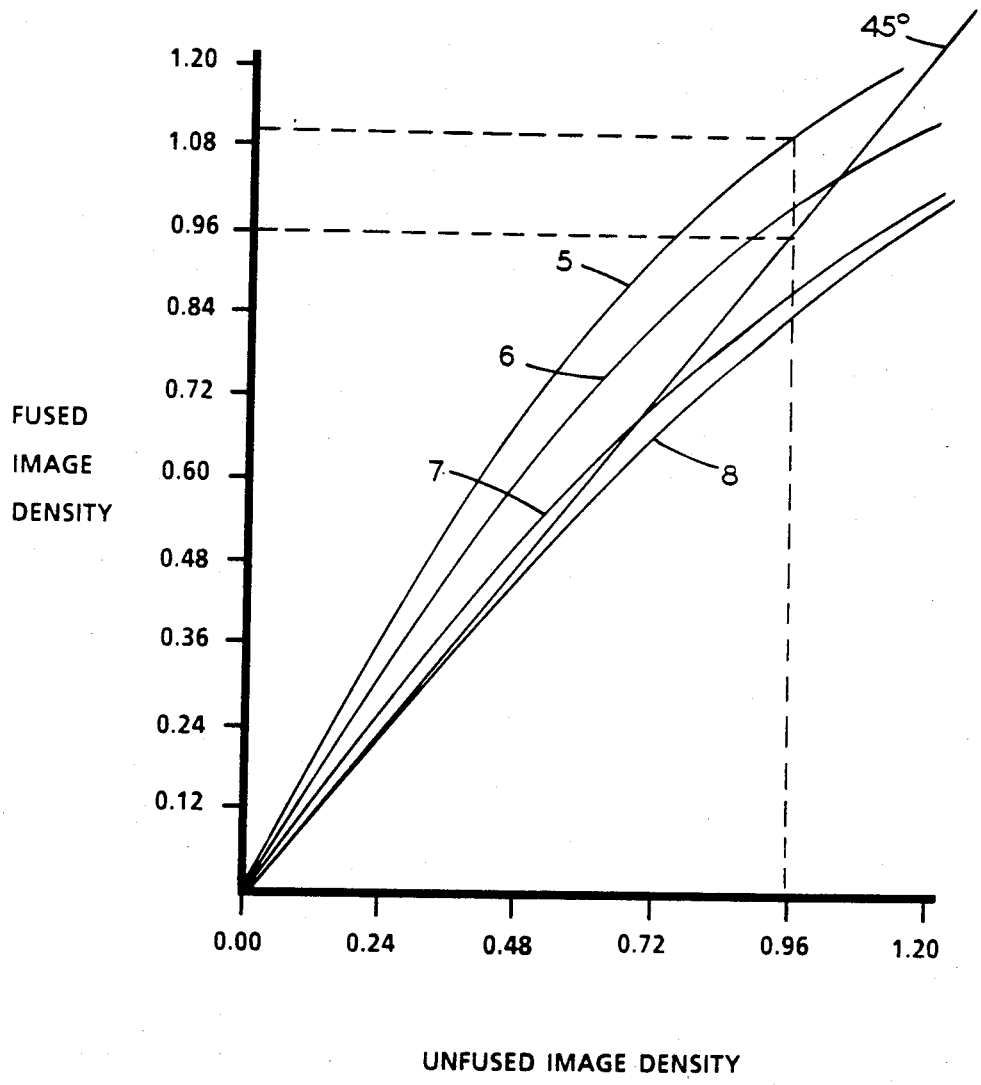
FIG. 2 represents line graphs plotting the unfused density versus the fused image density for toners that have been heat spheroidized.

To further demonstrate the reduction in energy consumption and image de-enhancement, there was plotted the fused image density versus the unfused image density for the above-prepared toner compositions with the results as illustrated in FIGS. 1 and 2.

FIG. 1 represents four different fusing energies of a toner composition with the above components that have not been heat spheroidized.

The aforementioned line graphs 1 to 4 represent different flash fusing energies 7, 6, 5, and 4 joules/inch$^2$ respectively. The 45° demarcation line signifies a boundary between image de-enhancement and image enhancement. Thus, all the data that appears above the 45° line represents image enhancement while the data which appears below the 45° line evidences image de-enhancement. Any data which coincides exactly with the 45° line signifies neither enhancement nor de-enhancement, but rather indicates that during the future fusing process the density of the image was not altered.

With reference to FIG. 2, lines 5,6,7 and 8 represent 7, 6, 5 and 4 joules/inch$^2$ using fusing energies. The data in FIG. 2 is for a toner composition identical to that as described with reference to FIG. 1 with the exception that the data for FIG. 2 is for heat spheroidized toners prepared in accordance with the process of the present invention.

With further respect to FIG. 1, that is, nonspherical toner, and FIG. 2, that is, spherical toner; FIG. 1 evidences, for example, an unfused image density at 0.96 which is fused at 7 joules/inch$^2$ and has a final fused density at 0.96. In contrast, FIG. 2 evidences that for spheroidized toner, an unfused density of 0.96, which is fused at 7 joules/inch$^2$ will have a fused density of 1.1. Consequently, the data for FIG. 2, that is, spheroidized toners prepared in accordance with the process of the present invention established that the spherical toners only require 5.5 joules/inch$^2$ to obtain a 0.96 fused density from a 0.96 unfused density.

EXAMPLE II

There were prepared toner compositions by repeating the procedures of Example I with the exception that there were selected as resins particles 52 percent by weight of a styrene butadiene, 89 percent by weight of styrene, and 11 percent by weight of butadiene; 22 percent by weight of an n-butyl methacrylate copolymer, 58/42; 20 percent by weight of a polypropylene wax of a molecular weight of about 6,000; 6 percent by weight of Black Pearls L carbon black; and 0.25 percent by weight of Aerosil. As with Example I, heat spheroidized toners and toners that were not heat spheroidized were prepared.

Figure 3:
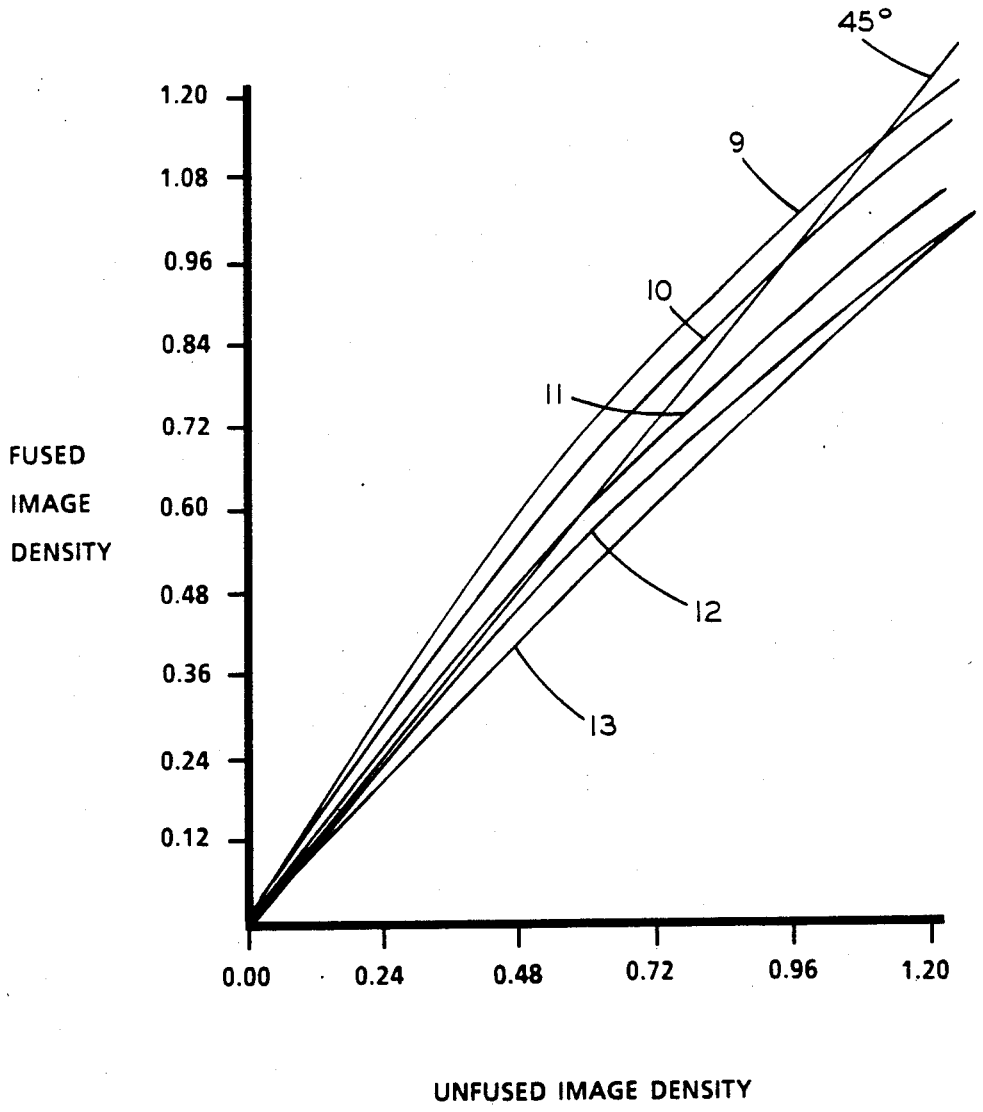
FIG. 3 represents line graph curves wherein the unfused image density is plotted against the fused image density, wherein the toner composition has not been heat spheroidized.
Figure 4:
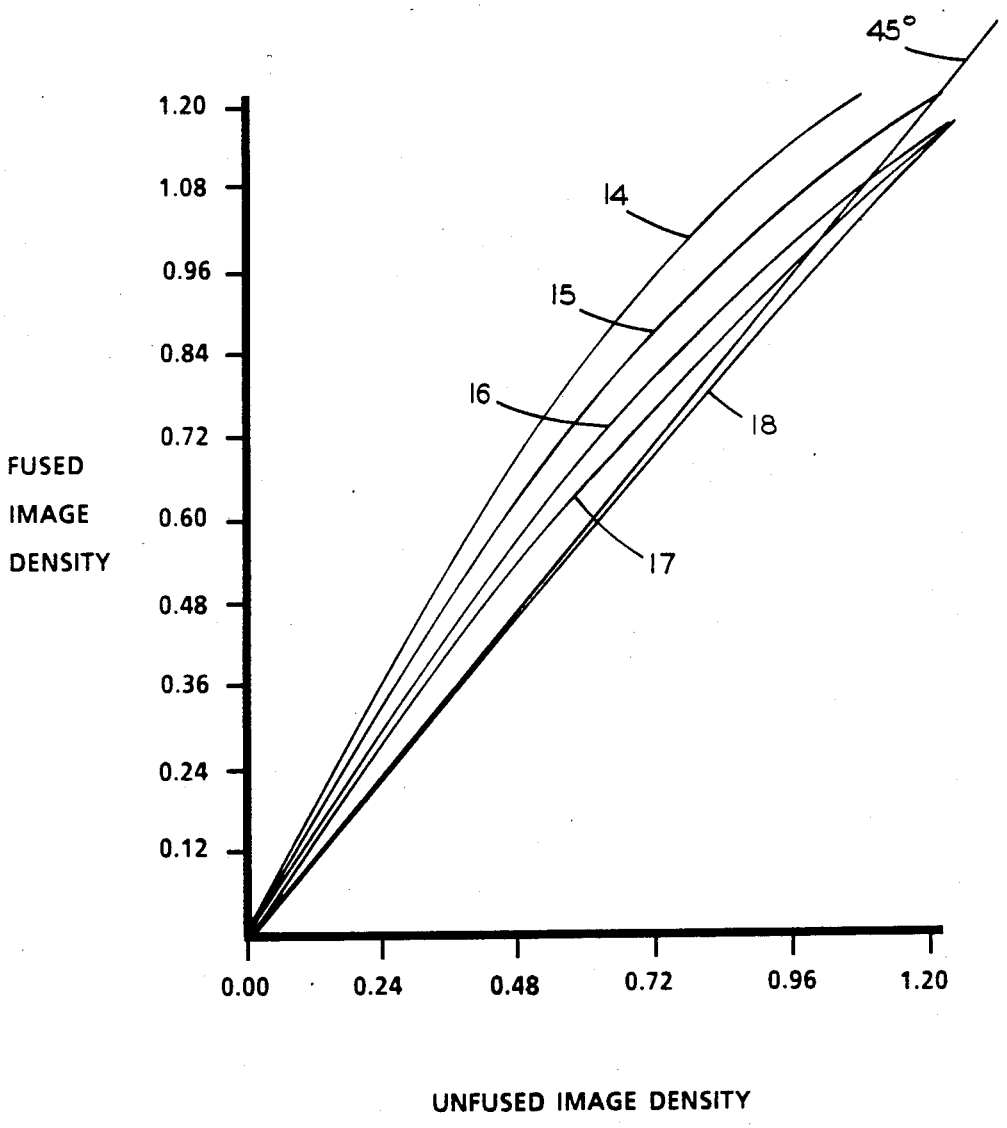
FIG. 4 represents line graphs plotting the unfused density versus the fused image density for toners that have been heat spheroidized.

The data generated for these toner compositions is illustrated in FIGS. 3 and 4, which are line graphs plotting fused image density versus unfused image density.

With further respect to FIGS. 3 and 4, line graphs 9 to 13, and 14 to 18, represent flash fusing energies of 7, 6, 5, 4 and 3 joules/inch$^2$ respectively. Interpreting the data presented in FIGS. 3 and 4 is as described herein with reference to FIGS. 1 and 2. Thus, for example, the unspheroidized toner of FIG. 3 evidences, for example, that a fusing energy of 6.5 joules/inch$^2$ is required to transform a 1.08 unfused density to a 1.08 fused density. In contrast, for the heat spheroidized equivalent toner of FIG. 4, a fusing energy of only 5 joules/inch$^2$ is required to transform a 1.08 unfused density to a 1.08 fused density.

Furthermore, the curves generated in the Figures were accomplished by producing xerographic solid area images over a range of densities of 0.1 to about 1.5, followed by measuring the unfused densities; and subsequently accomplishing fusing with a Xenon fusing lamp over a range of flash fusing energies of from 4 to about 7 joules/inch$^2$. After fusing, the densities were measured again and plotted where the unfused density was the abscissa, the fused density was the ordinate, and wherein each of the curves represents a specific fusing energy.

Other modifications of the present invention will occur to those skilled in the art upon a reading of the present disclosure. These are intended to be included within the scope of this invention.

What is claimed is:

1. A process for affecting a reduction in fusing energy and permitting minimal image de-enhancement which comprises (1) providing a toner composition with toner resin particles, and pigment particles; (2) affecting spheroidization of the aforementioned toner composition, (3) incorporating the spheroidized toner composition into a xerographic imaging apparatus with a flash fusing device incorporated therein; (4) generating an electrostatic latent image in the imaging apparatus; (5) developing the image formed with the spherical toner composition; (6) transferring the image to a supporting substrate; and (7) permanently affixing the image thereto with energy emitted from a flash fusing device, and wherein there results about a 20 percent reduction in flash fusing energy requirements as compared to unspheroidized toner compositions.

2. A process in accordance with claim 1 wherein the toner particles are spheroidized by heat spheroidization.

3. A process in accordance with claim 1 wherein the toner particles are spheroidized by subjecting them to a temperature of about 400° to about 600° F. in a heat spheroidization apparatus.

4. A process in accordance with claim 1 wherein the spherical toner particles are of an average diameter of from about 10 microns to about 20 microns.

5. A process in accordance with claim 1 wherein the energy required to fuse the developed image to the supporing substrate is about 5 joules/inch$^2$.

6. A process in accordance with claim 1 wherein the resin particles are selected from the group consisting of polystyrenes, polymethacrylates, polyacrylates, polyesters, diolefins, and mixtures thereof.

7. A process in accordance with claim 1 wherein the pigment particles are carbon black.

8. A process in accordance with claim 1 wherein there is further included in the toner composition additive particles.

9. A method for the formulation of images with improved optical density and minimal image de-enhancement which comprises affecting the development of images with spherical toner particles prepared by a process which comprises (1) providing a toner composition with toner resin particles, pigment particles, and additive particles; (2) affecting spheroidization of the aforementioned toner composition; (3) incorporating the spheroidized toner composition into a xerographic imaging apparatus with a flash fusing device incorporated therein; (4) generating an electrostatic latent image in the imaging apparatus; (5) developing the image formed with the spherical toner composition; (6) transferring the image to a supporting substrate and (7) permanently affixing the image thereto with energy emitted from a flash fusing device, and wherein there results about a 20 percent reduction in flash fusing energy requirements as compared to unspheroidized toner compositions.

10. A method of imaging in accordance with claim 9 wherein the flash fusing device is a Xenon lamp emitting energy of from about 1 to about 7 joules/inch$^2$.

11. A method of imaging in accordance with claim 9 wherein the spherical toner selected is of an average diameter of from about 10 to about 20 microns.

12. A method of imaging in accordance with claim 9 wherein the average diameter of the spherical toner particles are from about 10 to about 12 microns.

13. A method of imaging in accordance with claim 9 wherein the toner particles are spheroidized by heat spheroidization.

14. A process in accordance with claim 1 wherein the fusing energy required for affixing the image is reduced from 7 joules/inch$^2$ to about 5 joules/inch$^2$.

15. A process in accordance with claim 9 wherein the fusing energy required for affixing the image is reduced from 7 joules/inch$^2$ to about 5 joules/inch$^2$.

16. A process for affecting a reduction in fusing energy and permitting minimal image de-enhancement which consists essentially of (1) providing a toner composition with toner resin particles, and pigment particles; (2) affecting spheroidization of the aforementioned toner composition resulting in toner particles with an average diameter of from about 10 microns to about 20 microns; (3) incorporating the spheroidized toner composition into a xerographic imaging apparatus with a flash fusing device incorporated therein; (4) generating an electrostatic latent image in the imaging apparatus; (5) developing the image formed with the spherical toner composition; (6) transferring the image to a supporting substrate; and (7) permanently affixing the image thereto with energy emitted from a flash fusing device, and wherein there results about a 20 percent reduction in flash fusing energy requirements as compared to unspheroidized toner compositions.

17. A process in accordance with claim 16 wherein the energy required for fixing is reduced from 7 joules/inch$^2$ to about 5 joules/inch$^2$.

* * * * *